US012129857B2

(12) United States Patent
Liang

(10) Patent No.: US 12,129,857 B2
(45) Date of Patent: Oct. 29, 2024

(54) BOTTOM-SUCTION SUBMERSIBLE PUMP

(71) Applicant: Cairong Liang, Guigang (CN)

(72) Inventor: Cairong Liang, Guigang (CN)

( * ) Notice: Subject to any disclaimer, the term of this patent is extended or adjusted under 35 U.S.C. 154(b) by 35 days.

(21) Appl. No.: 18/177,106

(22) Filed: Mar. 1, 2023

(65) Prior Publication Data

US 2024/0167479 A1 May 23, 2024

(30) Foreign Application Priority Data

Nov. 18, 2022 (CN) ..... 202223073135.X

(51) Int. Cl.

| | |
|---|---|
| ***F04D 13/08*** | (2006.01) |
| ***F04D 29/06*** | (2006.01) |
| ***F04D 29/22*** | (2006.01) |
| ***F04D 29/42*** | (2006.01) |

(52) U.S. Cl.

CPC ..... *F04D 13/086* (2013.01); *F04D 29/061* (2013.01); *F04D 29/22* (2013.01); *F04D 29/4293* (2013.01)

(58) Field of Classification Search

CPC .... F04D 13/086; F04D 29/22; F04D 29/4293; F04D 29/061

See application file for complete search history.

(56) References Cited

U.S. PATENT DOCUMENTS 3,748,066 A * 7/1973 Sully ..... F04D 13/086 415/121.2
3,960,467 A * 6/1976 Zsuppan ..... F04D 29/586 417/366
3,969,043 A * 7/1976 Bright ..... F04D 29/586 415/217.1
4,806,083 A * 2/1989 LaGrange ..... F04D 29/426 417/DIG. 1
4,985,181 A * 1/1991 Strada ..... A01K 63/047 261/87
5,714,814 A * 2/1998 Marioni ..... F04D 13/0626 417/372
6,072,255 A * 6/2000 Chiang ..... F04D 13/086 310/67 R
6,986,648 B2 * 1/2006 Williams ..... F04D 13/064 417/370
2016/0265536 A1 * 9/2016 Davis ..... F04D 29/4293
2021/0156385 A1 * 5/2021 Wang ..... A01K 7/02

FOREIGN PATENT DOCUMENTS

WO WO-2016131080 A1 * 8/2016 ..... F04D 13/06

* cited by examiner

*Primary Examiner* — Nathan C Zollinger

(57) ABSTRACT

The application relates to a bottom-suction submersible pump, wherein a pump body is combined with a base to form a water inlet cavity and combined with an upper cover to form a water outlet cavity, a water outlet passage connecting the water inlet cavity and the water outlet cavity is formed in the pump body; a stator and a circuit module are encapsulated in an accommodation cavity in the pump body, a permanent magnet rotor is installed on a mounting shaft fixed in a rotor mounting hole formed at the bottom of the accommodation cavity, the permanent magnet rotor is coaxially fixed at its lower end with an impeller which extends into the water inlet cavity; and the pump body is also provided with a return passage connecting the water outlet cavity and the rotor mounting hole, which brings water lubrication for rotation of the permanent magnet rotor.

8 Claims, 4 Drawing Sheets

BOTTOM-SUCTION SUBMERSIBLE PUMP

CROSS-REFERENCE TO RELATED APPLICATIONS

The present application claims the benefit of Chinese Patent Application No. 202223073135.X filed on Nov. 18, 2022. All the above are hereby incorporated by reference.

FIELD

The present application generally relates to submersible pumps, more particularly to a bottom-suction submersible pump.

BACKGROUND

Pet water dispensers fully take into account characteristics of cats, dogs and other animals that like to drink flowing live water. Water in a storage bucket at lower part of the water dispenser is conveyed to the upper part of the water dispenser by using a submersible pump, and then falls back into the storage bucket in the manner of a fountain to form circulating live water for pets to drink. The most commonly used submersible pump is a bottom-suction submersible pump. Water enters from the bottom of the submersible pump. A permanent magnet rotor is arranged on a mounting shaft set in a rotor mounting hole formed at the bottom of a pump body, and works with a stator encapsulated in the pump body to drive the impeller to rotate. Centrifugal force generated by rotation of the impeller causes water under the pump body to be transported to a water outlet above the pump body through a water outlet passage formed at one side of the pump body for discharge. Because the impeller is set close to the bottom of the submersible pump, the bottom-suction submersible pump can also work when water level in the bucket is low. However, after the water level is lower than the rotor mounting hole, the rotor mounting hole gradually becomes dry and loses lubrication. The rotation of the permanent magnet rotor around the mounting shaft in the rotor mounting hole will produce large noise, which will affect use experience of the product.

SUMMARY

The technical problem to be solved by the present application is to provide a bottom-suction submersible pump that can avoid noise at low water level in view of the above defects of the existing technology.

The technical solution adopted by the present application to solve the technical problem thereof is to provide a bottom-suction submersible pump, comprising a base, a pump body and an upper cover, wherein the pump body is combined at its lower end with the base to form a water inlet cavity, the pump body is combined at its upper end with the upper cover to form a water outlet cavity, a water outlet passage connecting the water inlet cavity and the water outlet cavity is formed in the pump body, the base is provided at its bottom with a water inlet which is connected with the water inlet cavity, and the upper cover is provided at its top with a water outlet which is connected with the water outlet cavity; an accommodation cavity is provided in the pump body, a stator and a circuit module are encapsulated in the accommodation cavity, a rotor mounting hole is formed at the bottom of the accommodation cavity, a permanent magnet rotor cooperated with the stator is installed on a mounting shaft fixed in the rotor mounting hole, and the permanent magnet rotor is coaxially fixed at its lower end with an impeller which extends into the water inlet cavity; and centrifugal force of rotation of the impeller makes water in the water inlet cavity enter the water outlet cavity through the water outlet passage and then be discharged from the water outlet; and wherein the pump body is also provided with a return passage connecting the water outlet cavity and the rotor mounting hole.

In the bottom-suction submersible pump according to an embodiment of the present application, the return passage is formed as a return pipe extending upward from the top of the rotor mounting hole through the accommodation cavity into the water outlet cavity.

In the bottom-suction submersible pump according to an embodiment of the present application, an outlet pipe is provided at the upper center of the upper cover, which forms the water outlet connected with the water outlet cavity.

In the bottom-suction submersible pump according to an embodiment of the present application, a downwardly extending side wall is provided on the upper cover, an upwardly extending upper side wall is provided at the upper end of the pump body, and the side wall of the upper cover and the upper side wall of the pump body are combined to form the water outlet cavity.

In the bottom-suction submersible pump according to an embodiment of the present application, an upwardly extending first annular wall is arranged around the water inlet in the base, a downwardly extending second annular wall that is compatible with shape of the first annular wall is provided at the lower end of the pump body, and the first annular wall and the second annular wall are inserted into each other to form the water inlet cavity.

In the bottom-suction submersible pump according to an embodiment of the present application, a mesh plate is buckle installed under a bottom plate corresponding to the first annular wall at the bottom of the base, the mesh plate is provided with a number of mesh holes, and a sundries collection chamber is formed between the mesh plate and the bottom plate.

In the bottom-suction submersible pump according to an embodiment of the present application, an upwardly extending side wall having a first anti-fooling insertion structure is provided on the base, a downwardly extending lower side wall having a second anti-fooling insertion structure matched with the first anti-fooling plug structure is provided at the lower end of the pump body, and when the side wall of the base is combined with the lower side wall of the pump body to make the first anti-fooling insertion structure and the second anti-fooling insertion structure plug into each other, the first annular wall and the second annular wall are inserted into each other to form the water inlet cavity.

In the bottom-suction submersible pump according to an embodiment of the present application, a plurality of suction cups are provided at the bottom of the base.

In the bottom-suction submersible pump according to an embodiment of the present application, an annular rim is formed around the outer circumference of the pump body.

In the bottom-suction submersible pump according to an embodiment of the present application, the pump body is also provided with a through hole for power line of the circuit module encapsulated in the accommodation cavity being led out.

Implementing the bottom-suction submersible pump according to the present application has the following beneficial effects: the bottom-suction submersible pump according to the embodiments of the present application is provided with a return passage connecting the water outlet cavity and the top of the rotor mounting hole in the pump body. When the water level is lower than the rotor mounting hole, the impeller rotates to transfer water in the water inlet cavity to the water outlet cavity, and then a small amount of water can flow into the rotor mounting hole through the return passage, providing lubrication for the permanent magnet rotor to rotate around the mounting shaft in the rotor mounting hole, avoiding noise and achieving the mute effect.

BRIEF DESCRIPTION OF THE DRAWINGS

The present application will be further described below in conjunction with accompanying drawings and embodiments. In the accompanying drawings.

DETAILED DESCRIPTION

In order to make the objectives, technical solutions, and advantages of the present application clearer, the following further describes the present application in detail with reference to the accompanying drawings and embodiments. It should be understood that the specific embodiments described here are only used to explain the present application, and are not used to limit the present application. Moreover, in the case of no conflict, the embodiments in the application and the technical features in the embodiments can be combined with each other.

Figure 1:
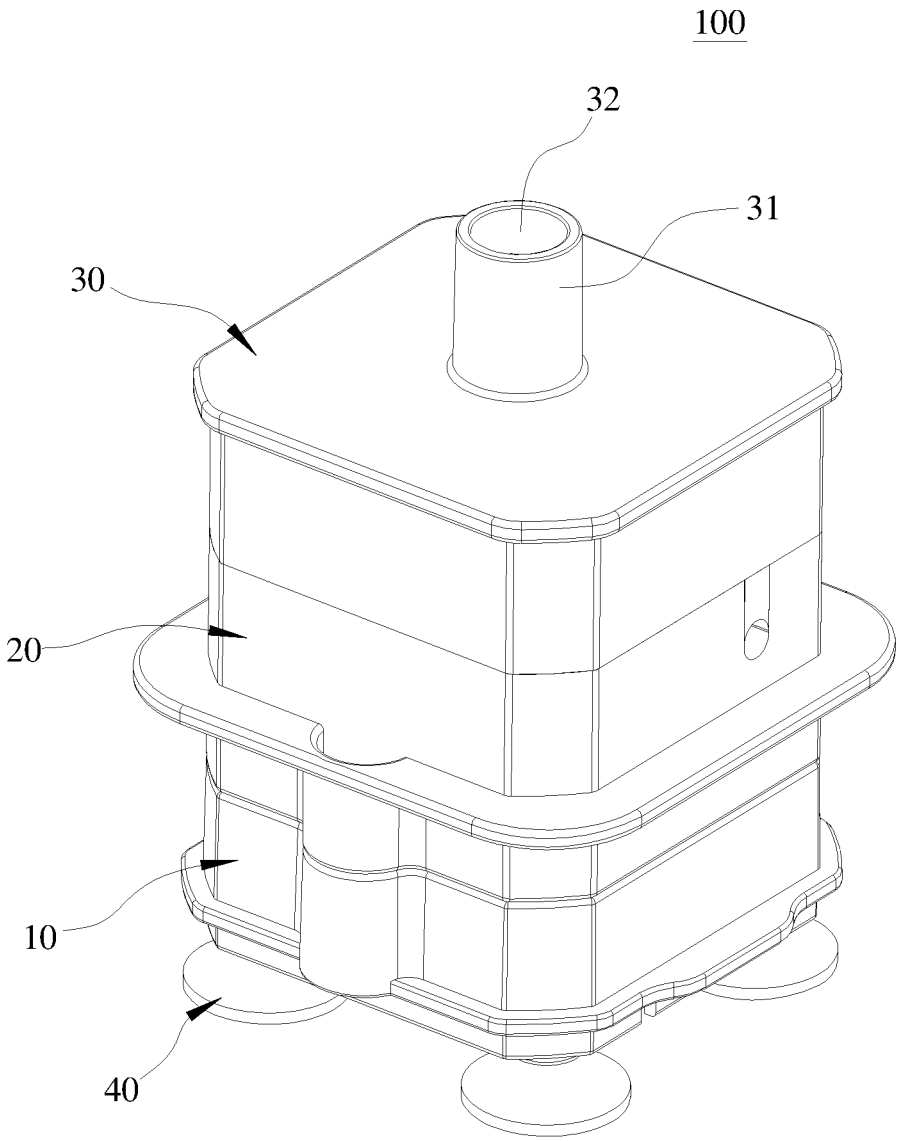
FIG. 1 is an external structural diagram of a bottom-suction submersible pump according to an embodiment of the present application.
Figure 2:
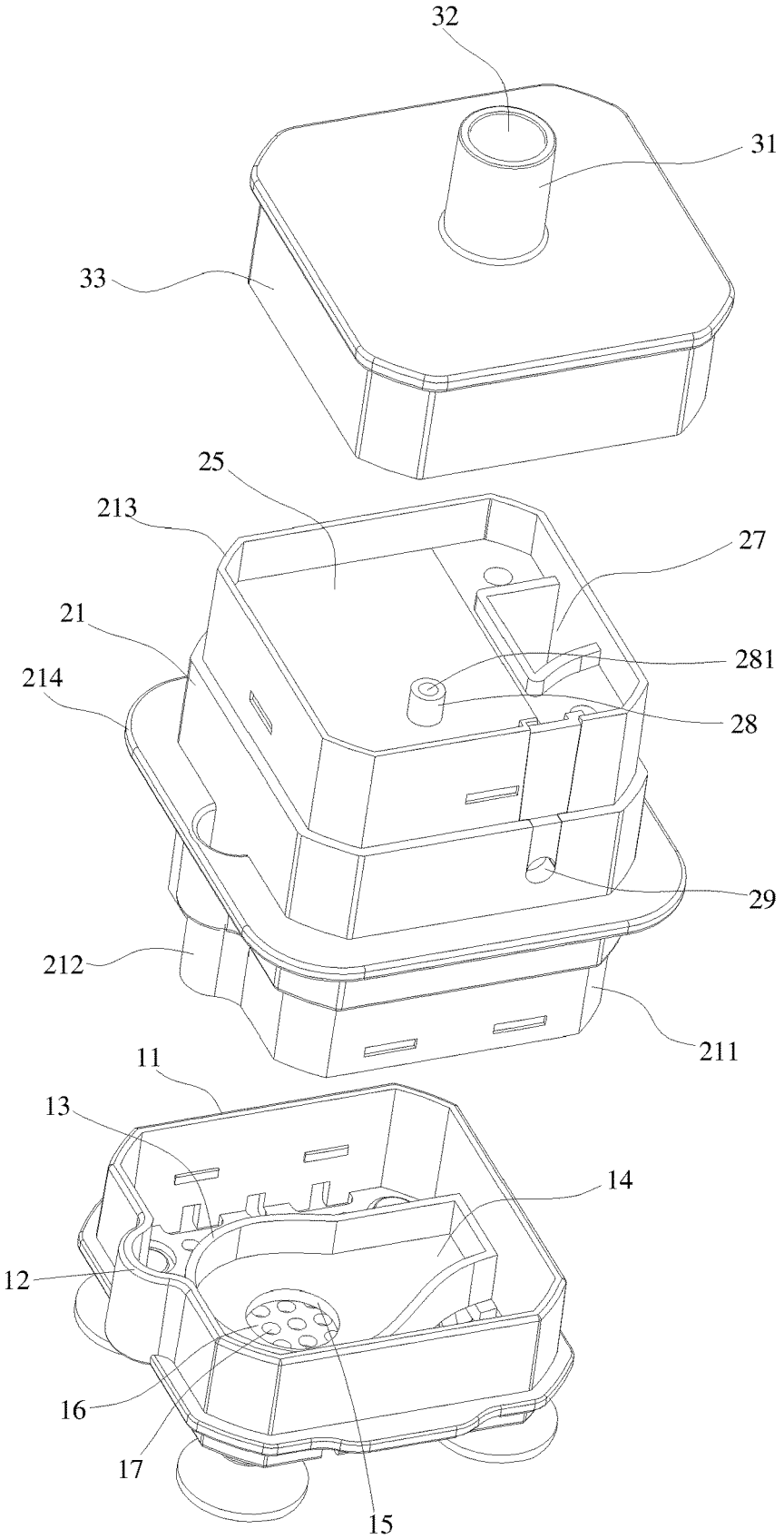
FIG. 2 is an explosive structural diagram of the bottom-suction submersible pump shown in FIG. 1.
Figure 5:
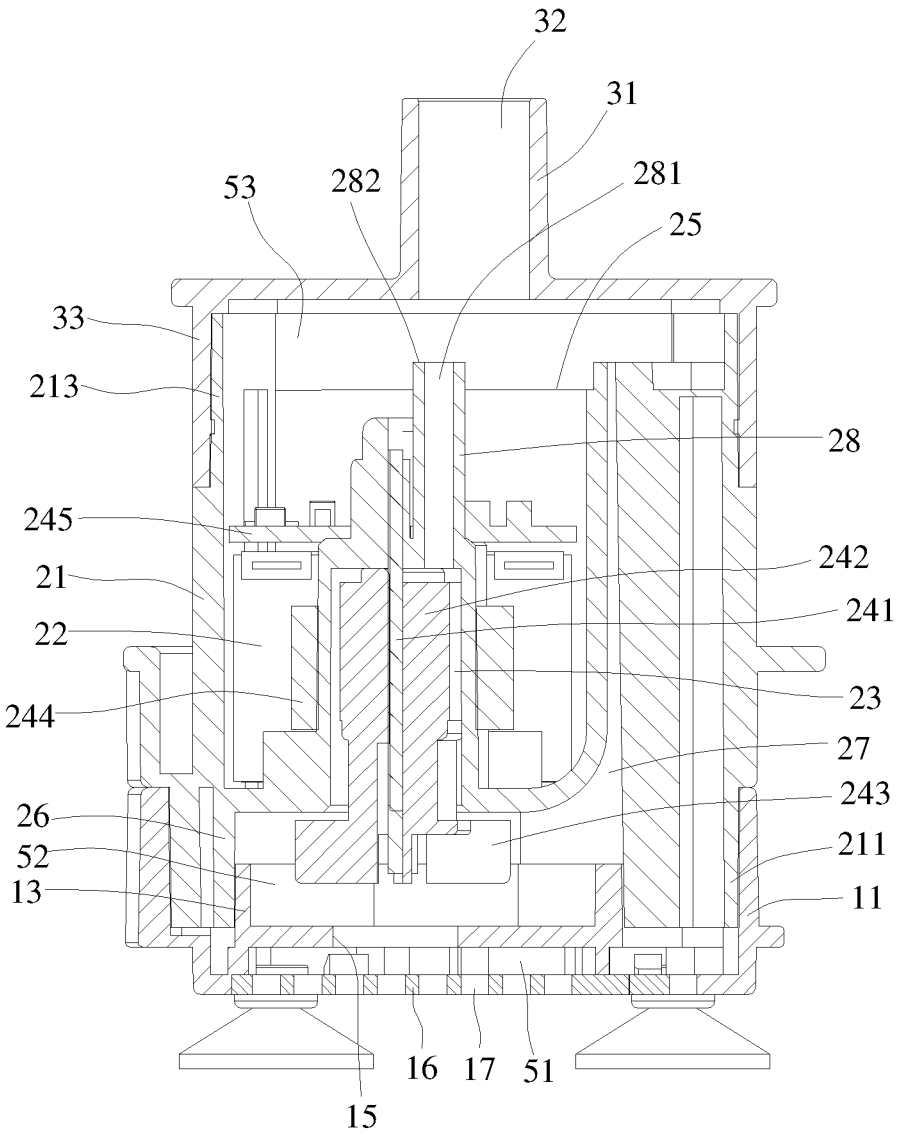
FIG. 5 is an internal structural sectional view of the bottom-suction submersible pump shown in FIG. 1.

FIG. 1 shows an external structural diagram of a bottom-suction submersible pump 100 according to an embodiment of the present application, FIG. 2 shows an explosive structural diagram of the bottom-suction submersible pump 100 shown in FIG. 1, and FIG. 5 shows an internal structural sectional view of the bottom-suction submersible pump 100 shown in FIG. 1. As shown in FIG. 1, FIG. 2 and FIG. 5, the bottom-suction submersible pump 100 is mainly composed of a base 10, a pump body 20 and an upper cover 30. The pump body 20 is combined at its lower end with the base 10 to form a water inlet cavity 52, the pump body 20 is combined at its upper end with the upper cover 30 to form a water outlet cavity 53, and a water outlet passage 27 connecting the water inlet cavity 52 and the water outlet cavity 53 is formed in the pump body. The base 10 is provided at its bottom with a water inlet 15 which is connected with the water inlet cavity 52, and the upper cover 30 is provided at its top with a water outlet 32 which is connected with the water outlet cavity 53. An accommodation cavity 22 is provided in the pump body 20, and a stator 244 and a circuit module 245 are encapsulated in the accommodation cavity 22. A rotor mounting hole 23 is formed at the bottom of the accommodation cavity 22, and a permanent magnet rotor 242 cooperated with the stator 244 is installed on a mounting shaft 241 fixed in the rotor mounting hole 23. The permanent magnet rotor 242 is coaxially fixed at its lower end with an impeller 243 which extends into the water inlet cavity 52. Centrifugal force of rotation of the impeller 243 makes water in the water inlet cavity 52 enter the water outlet cavity 53 through the water outlet passage 27 and then discharge from the water outlet 32.

Figure 3:
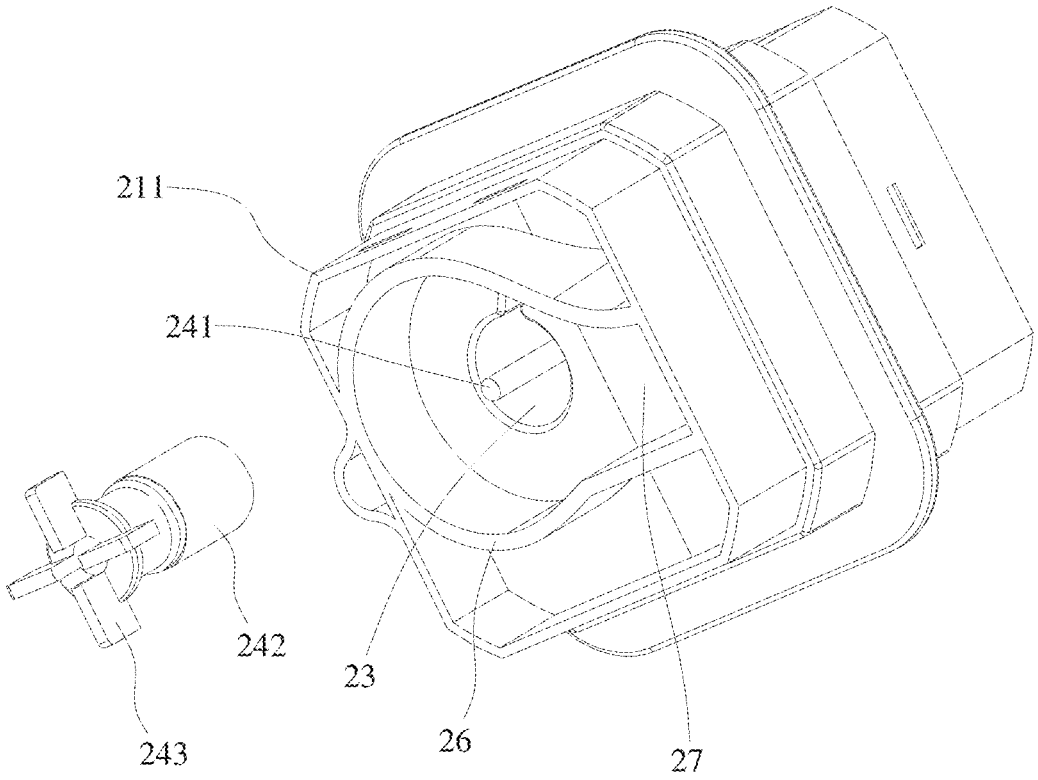
FIG. 3 is an explosive structural diagram of a pump body from another perspective in FIG. 2.

Referring to FIG. 2, FIG. 3 and FIG. 5 for details, the pump body 20 comprises a pump housing 21. The accommodation cavity 22 and the water outlet passage 27 independent of the accommodation cavity 22 are formed in the pump housing 21. The water outlet passage 27 passes through the lower end and the upper end of the pump housing 21. The stator 244 and the circuit module 245 are arranged in the accommodation cavity 22, and are sealed by adhesives such as epoxy resin, forming a sealing surface 25 at the upper end of the accommodation cavity 22. The circuit module 245 can be composed of a circuit board and various circuits and components such as a rectifier filter circuit, a voltage converter circuit, a voltage stabilizer circuit, etc. set on the circuit board. Power line of the circuit module 245 is led out through a through hole 29 opened on the pump housing 21 for external power supply. The rotor mounting hole 23 is formed at the bottom of the accommodation cavity 22, which is sealed with internal space of the accommodation cavity 22. The mounting shaft 241 is fixedly arranged at the center of the rotor mounting hole 23. The permanent magnet rotor 242 is installed on the mounting shaft 241 and works with the stator 244 encapsulated in the accommodation cavity 22. The working principle and specific implementation of the stator 244, the permanent magnet rotor 242 and the circuit module 245 are prior art, which will not be detailed in this application. The stator 244 is powered on to drive the permanent magnet rotor 242 to rotate, which drives the impeller 243 fixed on the lower end of the permanent magnet rotor 242 to rotate.

Further, as shown in FIG. 2, FIG. 3 and FIG. 5, an upwardly extending upper side wall 213 is provided at the upper end of the pump housing 21, and a downwardly extending side wall 33 is correspondingly provided on the upper cover 30. The side wall 33 of the upper cover 30 is sleeved on the outer side of the upper side wall 213 of the pump housing 21 and connected into a whole through matched buckle structures, so as to form the water outlet cavity 53 between the sealing surface 25 at the upper end of the pump body 20 and the upper cover 30. An outlet pipe 31 is provided at the upper center of the upper cover 30, which forms the water outlet 32 connected with the water outlet cavity 53. Further, a downwardly extending lower side wall 211 is provided at the lower end of the pump housing 21, and an upwardly extending side wall 11 is correspondingly provided on the base 10. The side wall 11 of the base 10 is sleeved on the outer side of the lower side wall 211 of the pump housing 21 and connected through matched buckle structures, so that the base 10 and the lower end of the pump body 20 is integrated as a whole. The base 10 is also provided with an upwardly extending first annular wall 13 around the water inlet 15, and the lower end of the pump housing 21 is correspondingly provided with a downwardly extending second annular wall 26 that is compatible with the shape of the first annular wall 13. The second annular wall 26 is inserted into the first annular wall 13 to form the water inlet cavity 52. The rotor mounting hole 23 is formed within a surrounding range of the second annular wall 26, so that the impeller 243 extends into the water inlet chamber 52. The water outlet passage 27 is also located on one side of the surrounding range of the second annular wall 26, so that the water outlet passage 27 connects the water inlet chamber 52 with the water outlet chamber 53. In order to facilitate the connection between the base 10 and the lower end of the pump housing 21 so that the first annular wall 13 and the second annular wall 26 can be inserted without being out of alignment, the side wall 11 of the base 10 is formed with an arc-shaped groove part 12 as a first anti-fooling insertion structure, and the lower side wall 211 of the pump housing 21 is provided with an arc-shaped convex part 212 matching with the arc-shaped groove part 12 as a second anti-fooling insertion structure. When the arc-shaped groove part 12 of the base 10 is inserted with the arc-shaped convex part 212 of the pump housing 21, the first annular wall 13 in the base 10 is just aligned with the second annular wall 26 at the lower end of the pump housing 21 to form the water inlet cavity 52.

Figure 4:
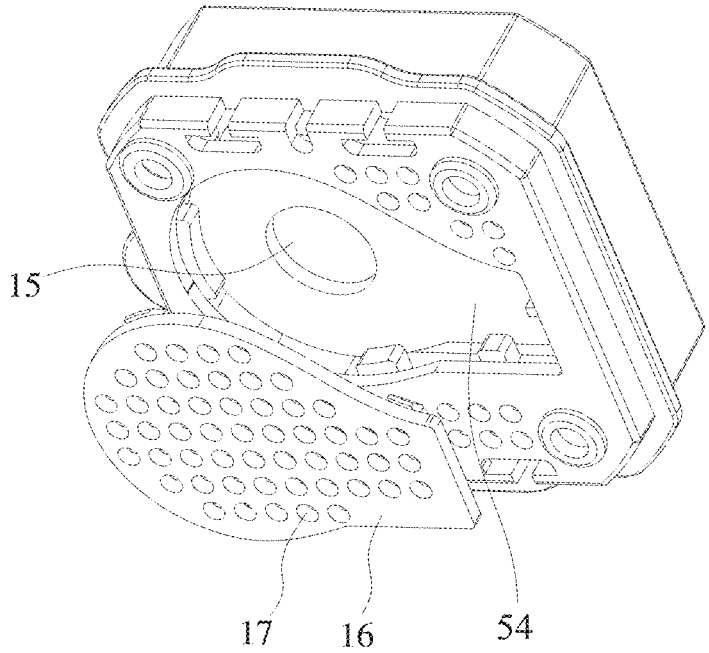
FIG. 4 is an explosive structural diagram of a base from another perspective in FIG. 2.

As shown in FIG. 4 and FIG. 5, a mesh plate 16 is buckle in a recessed part 54 under a bottom plate 14 corresponding to the first annular wall 13 at the bottom of the base 10. The mesh plate 16 is provided with a number of mesh holes 17, which can act as a filter screen to block sundries in the water entering through the mesh holes 17. At the same time, a sundries collection chamber 51 is also formed in the recessed part 54 between the mesh plate 16 and the bottom plate 14. The sundries in the water that have entered the sundries collection chamber 51 through the mesh holes 17 of the mesh plate 16 and even in the water inlet cavity 52 can be gradually deposited on upper surface of the mesh plate 16 in the sundries collection chamber 51. Collected sundries can be removed by removing the mesh plate 16 for cleaning.

When placing the bottom-suction submersible pump 100 according to the above embodiment of the present application in a container containing water and connecting it to power supply for operation, the centrifugal force of rotation of the impeller 243 makes water in the water inlet cavity 52 enter the water outlet cavity 53 through the water outlet passage 27 and then discharge from the water outlet 32. When water level in the container is high and the rotor mounting hole 23 and the permanent magnet rotor 242 therein is submerged in water, the permanent magnet rotor 242 rotates around the mounting shaft 241 in the rotor mounting hole 23 with sufficient lubrication and will not generate noise. When the water level in the container is low and both the rotor mounting hole 23 and the permanent magnet rotor 242 therein are exposed to water, the lubrication effect will be lost when the rotor mounting hole 23 is gradually dried. For this reason, the bottom-suction submersible pump 100 is also provided with a return pipe 28 in the pump body 20. The return pipe 28 extends upward from the top of the rotor mounting hole 23 through the accommodation cavity 22 and then extends into the water outlet cavity 53 (that is, a top surface 282 of the return pipe 28 is higher than the sealing surface 25 of the accommodation cavity 22), forming a return passage 281 connecting the water outlet cavity 53 and the rotor mounting hole 23, as shown in FIG. 5. In this way, a small amount of water in the water outlet cavity 53 flows into the rotor mounting hole 23 through the return passage 281 (see the arrow in FIG. 5), providing lubrication for the permanent magnet rotor 242 to rotate around the mounting shaft 241 in the rotor mounting hole 23, avoiding noise and achieving mute effect. According to various embodiments of the present application, the return passage 281 can also be realized in other suitable forms, which is not limited to the return pipe 28 in the illustrated embodiment, as long as the water outlet cavity 53 can be connected with the rotor mounting hole 23 to guide a small amount of water from the water outlet cavity 53 into the rotor mounting hole 23.

Further, as shown in FIG. 1 and FIG. 2, a plurality of suction cups 40 are provided at the bottom of the base 10 of the bottom-suction submersible pump 100, which are used to fix the entire bottom-suction submersible pump 100 in a container. An annular rim 214 is formed around the outer circumference of the pump housing 21 of the pump body 20 for easy access.

The above descriptions are only preferred embodiments of this application, and are not intended to limit this application. Any modification, equivalent replacement and improvement made within the spirit and principle of this application shall be included within the protection scope of this application.

I claim:

1. A bottom-suction submersible pump, comprising a base, a pump body and an upper cover, wherein the pump body is combined at its lower end with the base to form a water inlet cavity, the pump body is combined at its upper end with the upper cover to form a water outlet cavity, a water outlet passage connecting the water inlet cavity and the water outlet cavity is formed in the pump body, the base is provided at its bottom with a water inlet which is connected with the water inlet cavity, and the upper cover is provided at its top with a water outlet which is connected with the water outlet cavity; an accommodation cavity is provided in the pump body, a stator and a circuit module are encapsulated in the accommodation cavity, a rotor mounting hole is formed at the bottom of the accommodation cavity, a permanent magnet rotor cooperated with the stator is installed on a mounting shaft fixed in the rotor mounting hole, and the permanent magnet rotor is coaxially fixed at its lower end with an impeller which extends into the water inlet cavity; and centrifugal force of rotation of the impeller makes water in the water inlet cavity enter the water outlet cavity through the water outlet passage and then be discharged from the water outlet; and wherein the pump body is also provided with a return passage connecting the water outlet cavity and the rotor mounting hole;

an upwardly extending first annular wall is arranged around the water inlet in the base, a downwardly extending second annular wall that is compatible with the shape of the first annular wall is provided at the lower end of the pump body, and the first annular wall and the second annular wall are inserted into each other to form the water inlet cavity; and a mesh plate is buckled in a recessed part under a bottom plate corresponding to the first annular wall at the bottom of the base, the mesh plate is provided with a number of mesh holes, and a sundries collection chamber is formed in the recessed part between the mesh plate and the bottom plate.

2. The bottom-suction submersible pump according to claim 1, wherein the return passage is formed as a return pipe extending upward from the top of the rotor mounting hole through the accommodation cavity into the water outlet cavity.

3. The bottom-suction submersible pump according to claim 1, wherein an outlet pipe is provided at the upper center of the upper cover, which forms the water outlet connected with the water outlet cavity.

4. The bottom-suction submersible pump according to claim 1, wherein a downwardly extending side wall is provided on the upper cover, an upwardly extending upper side wall is provided at the upper end of the pump body, and the side wall of the upper cover and the upper side wall of the pump body are combined to form the water outlet cavity.

5. The bottom-suction submersible pump according to claim 1, wherein an upwardly extending side wall having a first anti-fooling insertion structure is provided on the base, a downwardly extending lower side wall having a second anti-fooling insertion structure matched with the first anti-fooling insertion structure is provided at the lower end of the pump body, and when the side wall of the base is combined with the lower side wall of the pump body to make the first anti-fooling insertion structure and the second anti-fooling insertion structure plug into each other, the first annular wall and the second annular wall are inserted into each other to form the water inlet cavity.

6. The bottom-suction submersible pump according to claim 1, wherein a plurality of suction cups are provided at the bottom of the base.

7. The bottom-suction submersible pump according to claim 1, wherein an annular rim is formed around the outer circumference of the pump body.

8. The bottom-suction submersible pump according to claim 1, wherein the pump body is also provided with a through hole for a power line of the circuit module encapsulated in the accommodation cavity being led out.

* * * * *